United States Patent [19]

Brattoli

[11] Patent Number: 5,031,658

[45] Date of Patent: Jul. 16, 1991

[54] PLASTER GROUND WITH FASTENER-FREE MOUNTING

[75] Inventor: Michael A. Brattoli, Elyria, Ohio

[73] Assignee: Moen Incorporated, Flyria, Ohio

[21] Appl. No.: 570,512

[22] Filed: Aug. 21, 1990

[51] Int. Cl.[5] ..... F16K 27/08

[52] U.S. Cl. ..... 137/377; 137/360; 4/191

[58] Field of Search ..... 137/377, 359, 360, 382; 4/191, 192, 654, 655, 657, 658

[56] References Cited

U.S. PATENT DOCUMENTS 3,167,855 2/1965 Moen ..... 29/157

4,762,144 8/1988 Ford ..... 137/382.5

4,896,381 1/1990 Hutto ..... 4/191

*Primary Examiner*—Martin P. Schwadron

*Assistant Examiner*—Kevin L. Lee

*Attorney, Agent, or Firm*—Kinzer, Plyer, Dorn, McEachran & Jambor

[57] ABSTRACT

A plaster ground for a wall mounted faucet valve housing includes a body portion with a central opening for the valve housing and a cylindrical portion releasably attached to the body portion and extending about the valve housing. A pair of flexible retaining arms integral with the body portion are adapted to engage and secure the plaster ground to the valve housing.

9 Claims, 2 Drawing Sheets

Fig. 1.
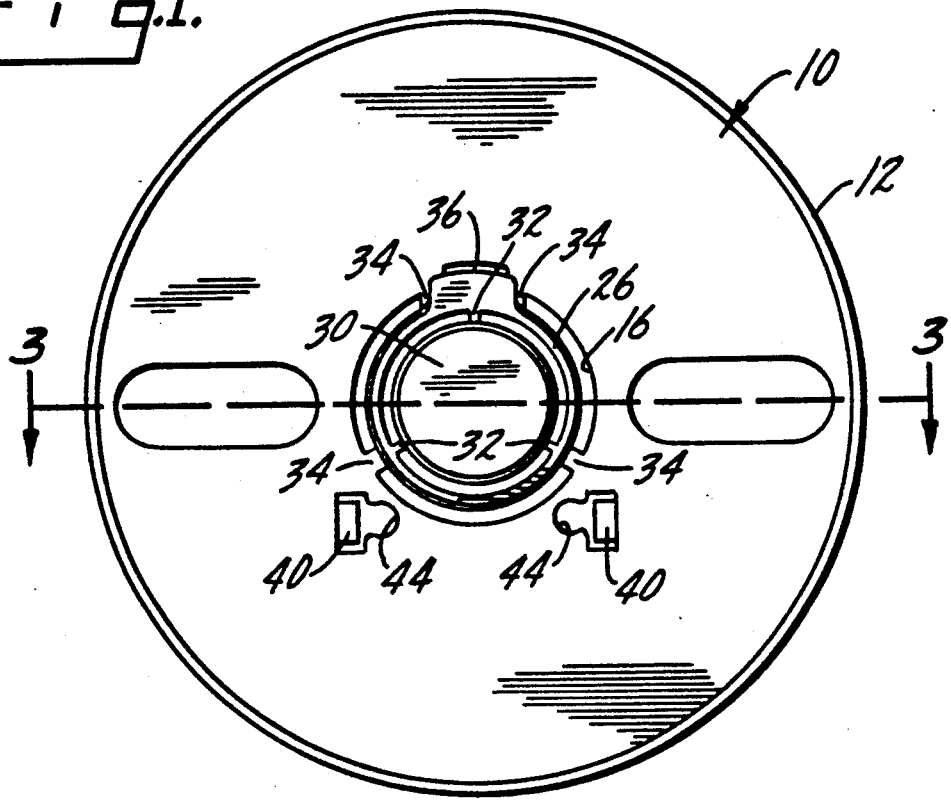
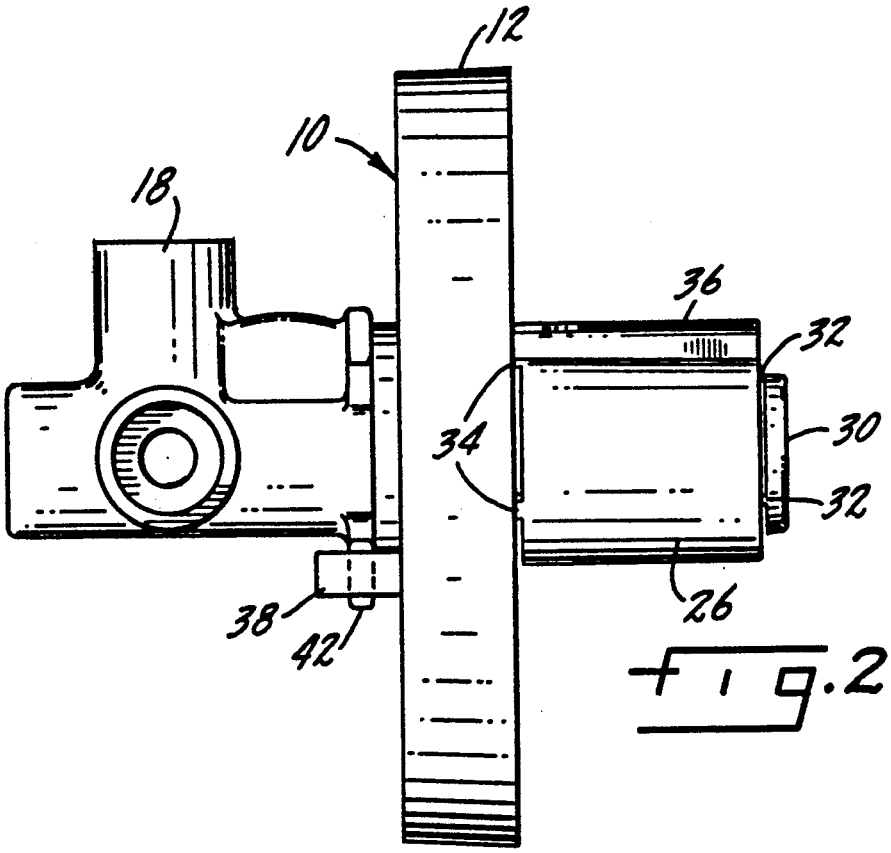
Fig. 2.

PLASTER GROUND WITH FASTENER-FREE MOUNTING

SUMMARY OF THE INVENTION

The present invention relates to plaster grounds for wall mounted faucet valves and particularly to a plaster ground having integral flexible retaining arms to attach the plaster ground to the valve housing.

Another purpose of the invention is a plaster ground as described which includes a valve housing cover attached to the plaster ground body by breakaway connections.

Another purpose is to provide a simply constructed reliable plaster ground which has the valve housing attachment integrally formed therein.

Another purpose is to provide a plaster ground which can be attached to a valve housing without conventional fasteners, such as screws.

Other purposes will appear in the ensuing specification, drawings and claims.

BRIEF DESCRIPTION OF THE DRAWINGS

The invention is illustrated diagrammatically in the following drawings wherein:

FIG. 1 is a front view of the plaster ground of the present invention,

FIG. 2 is a side view of the plaster ground as positioned on a valve housing.

DESCRIPTION OF THE PREFERRED EMBODIMENT

Figure 3:
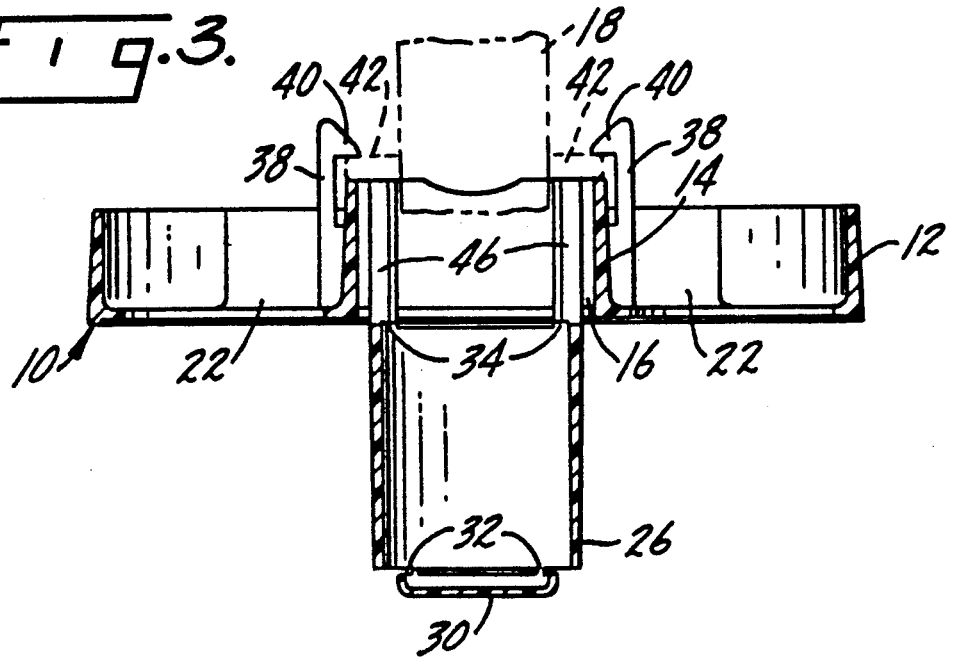
FIG. 3 is a section along plane 3—3 of FIG. 1.
Figure 4:
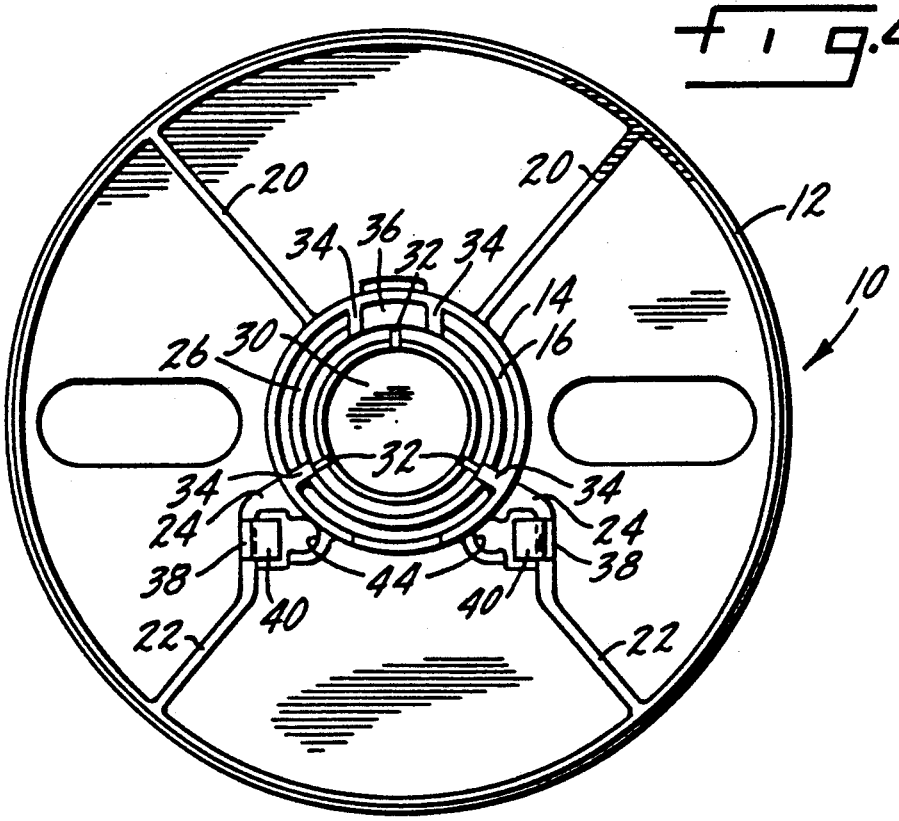
FIG. 4 is a rear view of the plaster ground.

Plaster grounds, or as they are sometimes called in the trade, plaster guards, are used to provide protection for a wall mounted mixing valve during installation of the surrounding walls and to insure the proper spatial relationship between the wall and the roughed-in plumbing including the mixing valve housing. U.S. Pat. No. 3,167,855, owned by the assignee of the present application, shows an early form of plaster ground in which the body of the plaster ground was formed of plastic and the mixing valve housing which extended through the plaster ground could be covered by a separate cardboard tube to protect the mixing valve during construction of the shower stall walls. Subsequent to that patent, Moen Incorporated, the assignee of the present application, replaced the cardboard tube with a plastic cylinder, closed at the end, with the cylinder being attached to the plaster ground body by one or more screws, with the screws being used to secure the plaster ground to the mixing valve housing. This construction has been on the market for at least five years. U.S. Pat. No. 4,896,381 shows another form of plaster ground in which the tube surrounding the mixing valve is attached to the plaster ground body by a breakaway connection. The structure shown in this patent has the serious disadvantage that the end of the cylindrical portion which covers the mixing valve is open, leaving the mixing valve unprotected from drywall compound which, in present day construction practices, may be sprayed onto gypsum board. Price Pfister, a faucet manufacturing company located in California, manufactures a plaster ground in which there is a cylindrical portion to enclose the mixing valve body, which cylindrical portion is molded integral with the body of the plaster ground and in which there is a small cap or cover on the end of the cylindrical portion which is attached thereto by a breakaway connection. This type of plaster ground, as well as the structure shown in the above-mentioned '381 patent, require screws or some form of separate fastener to attach the plaster ground to the valve housing.

The present invention provides a plaster ground in which there is a body formed of a suitable plastic, a central opening in the body for the mixing valve housing, a cylindrical portion which is attached by breakaway connections to the body, and an end cap or cover which is attached by breakaway connections to the cylindrical portion. The improvement is specifically directed to the means for attaching the plaster ground to the mixing valve housing which, as disclosed herein, is in the form of a pair of flexible retaining arms which snap onto portions of the mixing valve housing to securely and correctly position the plaster ground on the housing. This type of connection eliminates the screws which were used in all previous forms of plaster grounds. The resulting connection of the plaster ground to the mixing valve housing is quicker and less expensive than the previously-used screw connections.

The plaster ground of the present invention is formed of plastic and all parts of the structure are integral and formed in one molding operation. The body of the plaster ground is indicated at 10 and in the disclosed embodiment is circular, although the invention should not be limited to such a configuration. The body 10 includes a rearwardly directed outer flange 12. There is a rearwardly-directed interior flange 14 which defines an opening 16 of a size and shape to receive a portion of the mixing valve housing indicated generally at 18. Interior flange 14 is connected to exterior flange 12 by a plurality of spaced radially-extending webs 20. Webs 22, also connecting the interior and exterior flanges, although radial in part, have an offset portion 24, as will be described hereinafter.

The plaster ground includes a cylindrical portion 26 which extends outwardly from body 10 and is of a size and shape to receive a cylindrical portion of the mixing valve housing 18. The mixing valve is positioned in that part of the valve housing within plaster ground cylindrical portion 26 and this valve is accessible for test purposes from the front of cylindrical portion 26 after removal of an end cap 30. End cap 30 is connected to the cylindrical portion 26 by breakaway connections 32 and cylindrical portion 26 is connected to body 10 by breakaway connections 34. In the plaster ground as disclosed herein, either the end cap 30 may be removed, or the entire cylindrical portion may be removed, by the individual breakaway connections.

The size and shape of the plaster ground shown is specifically designed to receive a shower/tub housing for a mixing valve of the type made by Moen Incorporated. This type of wall mounted faucet customarily uses what is termed a "stop tube" which is effective to limit rotation of the mixing valve in the hot water direction to prevent excessively hot water from discharging into the shower or tub. There is a channel 36 in the cylindrical portion which is designed to receive the stop portion of the stop tube, if the stop tube should be mounted on the mixing valve housing when the valve housing is installed. In some applications the stop tube will be so mounted, whereas, in other applications the stop tube may be positioned by the plumber after installation of the valve housing.

The plaster ground is attached to the mixing valve housing by a pair of flexible arms 38 which ar formed integral with the offset web portions 24 and extend rearwardly therefrom. Each of arms 38 has a hook 40, with the hooks extending over and attaching the plaster ground to flanges 42 on the mixing valve housing.

In assembly, once the plumber has roughed in the hot and cold water conduits and the shower and/or tub conduits which connect to the mixing valve housing 18, he may attach the plaster ground by pushing it rearwardly until the arms 38 bend away from and then snap back over the mixing valve housing flanges 42. The plaster ground is then securely attached to the mixing valve housing. The shower walls may then be mounted in position by conventional dry wall installation methods and there will be an opening for the plaster ground which is generally the size and shape of the plaster ground exterior, as defined by rearwardly extending flange 12. The protective cylindrical portion 26 and end cap 30 prevents any of the dry wall plaster compound, which may be sprayed during installation, from reaching the mixing valve. Once the dry wall compound has been sprayed and the walls are complete, either the end cap alone or the entire cylinder may be removed for testing of the plumbing system. In some installations the plaster ground will be removed, whereas, in others it will remain in place.

The body 10 includes openings 44 which are in alignment with threaded holes in the mixing valve housing flange 42. The decorative escutcheon which is customarily found in a shower/tub installation will be placed over the plaster ground after the cylindrical portion 26 has been removed and then the escutcheon will be attached by screws which extend through openings 44 into the threaded holes in the mixing valve housing. In past plaster grounds, these screw connections have been used to attach the plaster ground to the mixing valve housing and at times to attach a cylindrical protective cover to both the plaster ground and the mixing valve housing. The present invention, with the integral flexible arms 38, eliminates any need for screw connections for the plaster ground.

As particularly shown in FIG. 1, cylindrical portion 26 has an outer diameter which is less than the inner diameter of flange 14. The breakway connections 34 are in the form of axially extending and radially inwardly directed guides, as particularly shown at 46 in FIG. 3. These guides are closely adjacent, but slightly spaced from, the exterior of the mixing valve housing. When the cylindrical portion 26 is removed, these guides will remain in the body of the plaster ground.

Of importance in the invention is the use of flexible arms which are integral with the plaster ground to attach the plaster ground to the mixing valve housing. This eliminates the screw connections which were both labor intensive and costly. The plaster ground includes two breakaway parts which are used to access the mixing valve for tests. All parts of the plaster ground are molded in one operation and there are no pieces required for assembly except for the plaster ground itself.

Whereas the preferred form of the invention has been shown and described herein, it should be realized that there may be many modifications, substitutions and alterations thereto.

The embodiments of the invention in which an exclusive property or privilege is claimed are defined as follows:

1. A plaster ground for a wall mounted faucet valve housing including a body portion having a central opening formed and adapted to receive a valve housing, a cylindrical portion coaxial with said opening and releasably attached to said body portion, said cylindrical portion being formed to receive a valve housing therein, and means for attaching said body portion to the valve housing including flexible retaining means integral with said body portion and having interlocking means thereon adapted to engage with the valve housing.

2. The plaster ground of claim 1 further characterized in that said flexible retaining means are in the form of a pair of flexible arms.

3. The plaster ground of claim 2 further characterized in that each of said flexible arms has a hook portion adapted to engage the valve housing.

4. The plaster ground of claim 2 further characterized in that said flexible arms, when engaged with the valve housing, firmly hold said body portion to the valve housing.

5. The plaster ground of claim 1 further characterized by and including at least one opening in said body portion, in alignment with a threaded portion of the valve housing, for use in attaching an exterior escutcheon to the valve housing.

6. The plaster ground of claim 1 further characterized in that the cylindrical portion is attached to the body portion by breakaway connections.

7. The plaster ground of claim 6 further characterized in that said body portion and cylindrical portion are formed of a plastic material and are integrally formed together with breakaway connections between the cylindrical portion and the body portion.

8. The plaster ground of claim 1 further characterized in that said cylindrical portion includes a cover on the end thereof, said cover and said cylindrical portion enclosing the valve housing therein.

9. The plaster ground of claim 8 further characterized in that said cover is attached by breakaway connections to said cylindrical portion.

* * * * *